United States Patent [19]

Kratzer

[11] 3,997,167

[45] Dec. 14, 1976

[54] GAME OF TRACK AND FIELD SPORTS

[75] Inventor: Danny Alan Kratzer, Elkhart, Ind.

[73] Assignee: The Raymond Lee Organization, Inc., New York, N.Y.

[22] Filed: Aug. 5, 1975

[21] Appl. No.: 601,972

[52] U.S. Cl. ..... 273/134 CA; 273/134 ES; 273/142 JA; 273/142 H

[51] Int. Cl.[2] ..... A63F 3/00

[58] Field of Search ..... 273/134, 142

[56] References Cited

UNITED STATES PATENTS

| | | | |
|---|---|---|---|
| 780,937 | 1/1905 | Clagett | 273/134 CH UX |
| 1,449,393 | 3/1923 | French | 273/134 ES |
| 2,123,285 | 7/1938 | Miller | 273/142 JA |

FOREIGN PATENTS OR APPLICATIONS

| | | | |
|---|---|---|---|
| 1,275,511 | 10/1961 | France | 273/134 CA |
| 367,096 | 3/1963 | Switzerland | 273/134 CA |
| 764,210 | 12/1956 | United Kingdom | 273/134 CA |

*Primary Examiner*—Delbert B. Lowe
*Attorney, Agent, or Firm*—Stephen Wyden

[57] ABSTRACT

A game of runs, dashes, relays, shot puts, high jump, long jump, and pole vault for six players using two spinners, one marked in numbers, the other marked in measurements in feet and inches, a track, a score card, a grease pencil and six runner player pieces.

1 Claim, 6 Drawing Figures

FIG. 1
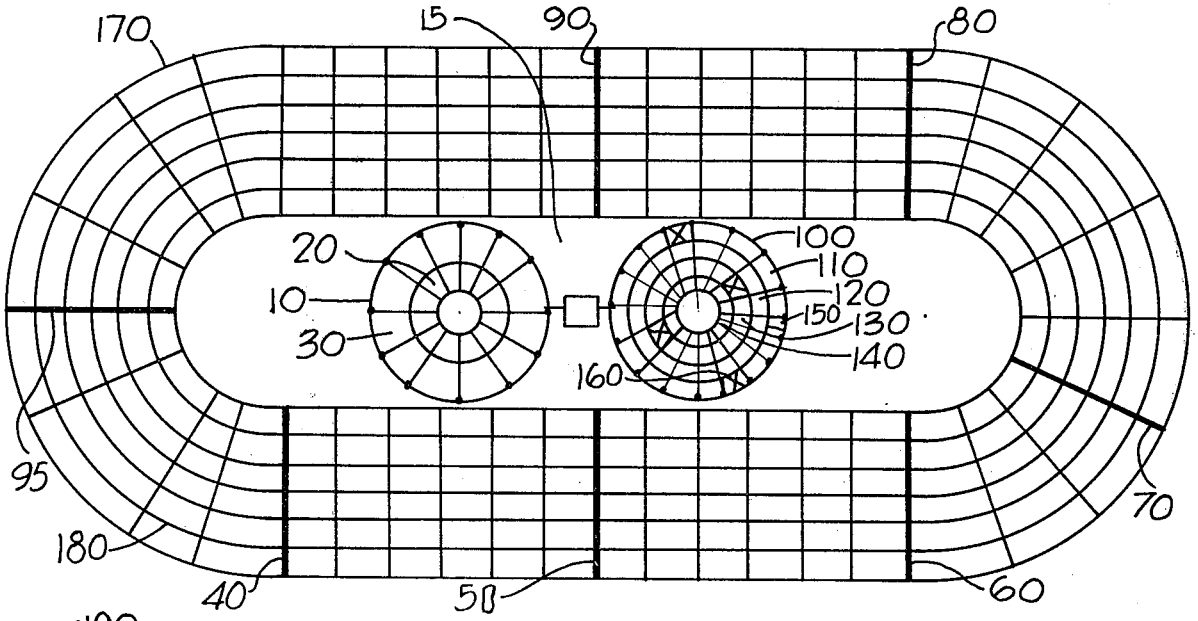
190
SCORE BOX
210
| EVENTS | RED | BLUE | GREEN | YELLOW | BLACK | WHITE |
|---|---|---|---|---|---|---|
| 1 MILE R. | | | | | | |
| 100 YD. DASH | | | | | | |
| 1/4 MILE RUN | | | | | | |
| 1 MILE RUN | | | | | | |
| 220 YD. DASH | | | | | | |
| 1/2 MILE RUN | | | | | | |
| 1/4 MILE RELAY | | | | | | |
| 1/2 MILE RELAY | | | | | | |
| SHOT PUT | | | | | | |
| HIGH JUMP | | | | | | |
| LONG JUMP | | | | | | |
| POLE VAULT | | | | | | |
| TOTAL | | | | | | |
200
220
FIG. 2
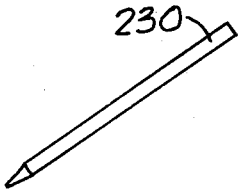
FIG. 3
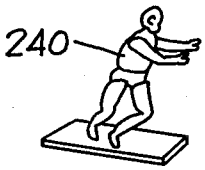
FIG. 4

GAME OF TRACK AND FIELD SPORTS

I have invented a new game of field sports using a track, two spinners, a score box and grease pencil to mark the score box, and six runner playing pieces. Any one of the sports can be played at any one time and each sport is played until there is a first, second, and third place winner. The first place winner receives 5 points, second place receives 3 points, and third place is worth 1 point.

My game can be understood in view of the accompanying figures.

FIG. 1 is an illustration of the playing field with the start and finish lines marked thereon and with the two spinners in the center of the field.

FIG. 2 illustrates the score box.

FIG. 3 illustrates the grease pencil.

FIG. 4 illustrates one of the six runner playing pieces.

Figure 5:
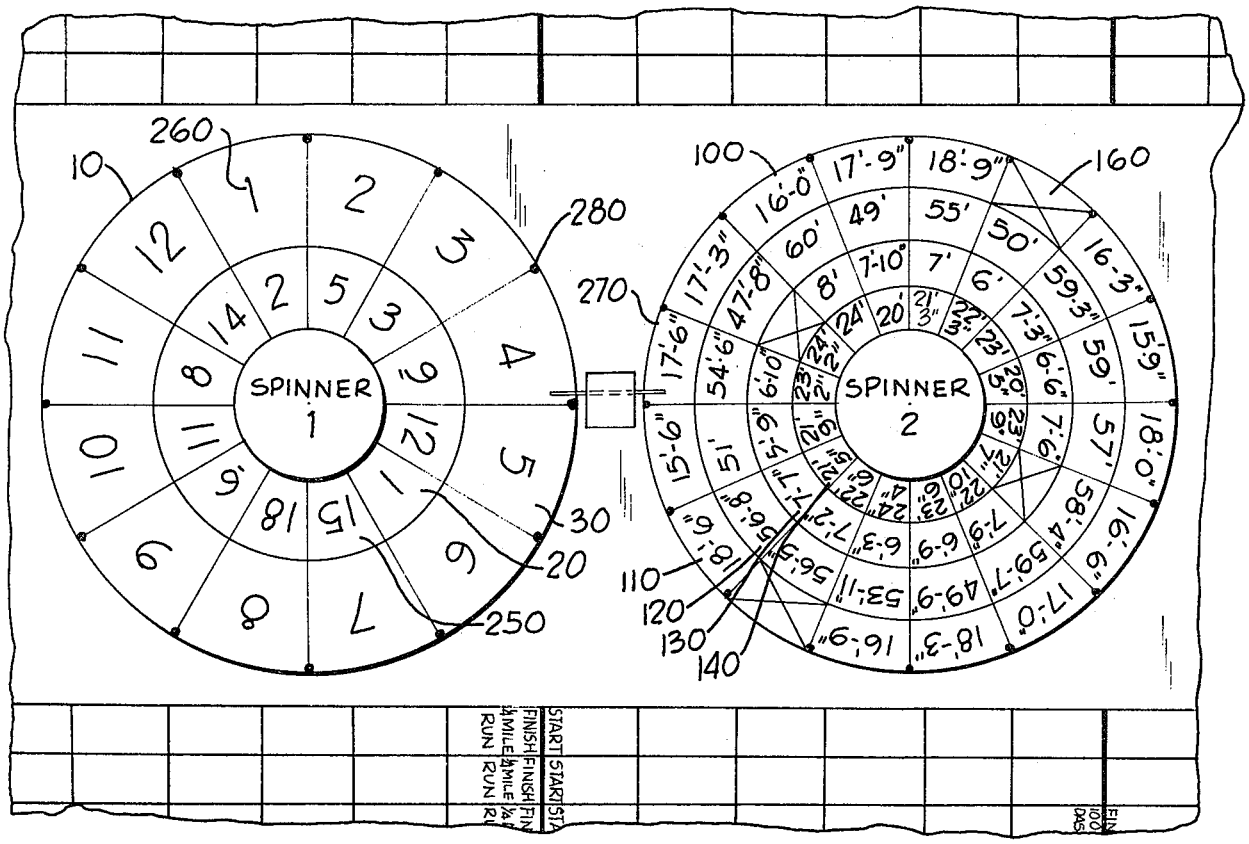
FIG. 5 shows the markings of the two spinners in a close up of the central section of FIG. 1.

In FIG. 1, the first spinner 10 mounted on the playing board 15 has an inner ring of numbers 20 colored green and an outer ring of numbers 30 colored red. A player spins the spinner to determine the number of spaces that his runner advances, using the red circle 30 for runs and dashes and using the green circle for relays. In relays, if the runner lands on a relay point, 40, 50, 60, 70, 80, 90 or 95, the player wins a second spin of the spinner 10.

The second spinner 100 has a red ring 110 for pole vaults, a blue ring 120 for shot puts, a green ring 130 for high jumps, and a yellow ring 140 for long jumps. Each space 150 is marked with selected measurements in inches and feet representing the distance traveled or height reached, depending on the event. In the red 110 and green 130 rings are two lose-turn spaces each 160. Each player has three turns of each event. If a player lands on a height or distance reached by another player, the second player's height or distance is increased by 1 inch. Subsequent players reaching the same height or distance tie with the second player at the actual height or distance plus one inch. First, second, and third place are the top three heights or distances reached. Where there are ties, first place is worth 4½ points, second place is worth 2½ points, and third place is worth ½ point.

The track 170 has a plurality of lines demarcating the paths for each runner 180. The bold lines have special functions: 50 is the start for the runs and the relays, 40 is the start of the 100 yard dash and the 220 yard dash, 60 is the finish for the 100 yard dash, 70 is the quarter mile relay mark, 80 is the finish for the 220 yard dash, 90 is the half mile and a second quarter mile relay mark, 95 is the three-quarter mile mark, a one half mile mark, and a one-quarter mile mark for relays and runs, and 50 is the finish for the mile, the last quarter mile, and last half mile runs, and for the mile, quarter mile, and half mile relays.

In FIG. 2, the score box 190 lists the various events on separate lines 200 and lists the colors of the players at the head of each of the six columns 210. The players scores are totalled across the bottom 220.

In FIG. 3 is illustrated a grease pencil 230 that can be used to mark the score box 190 of FIG. 2.

In FIG. 4 is one of the six runner pieces 240, each of which is in a separate color, chosen from among red, blue, green, yellow, black and white and is used to indicate the position that the player using the piece has reached in a particular event.

In FIG. 5, the first spinner 10 has random numbers 250 and 260 in both the first ring 20 and the outer ring 30. The second spinner 100 has a plurality of measurements, in inches and feet 270 in four concentric rings, 110, 120, 130, and 140, except for the four lose-turn spaces 160. The pegs 280 stop the spinners, 10 and 100, in contact with a peg pointer 290 to clearly indicate the intended valves for each game.

Figure 6:
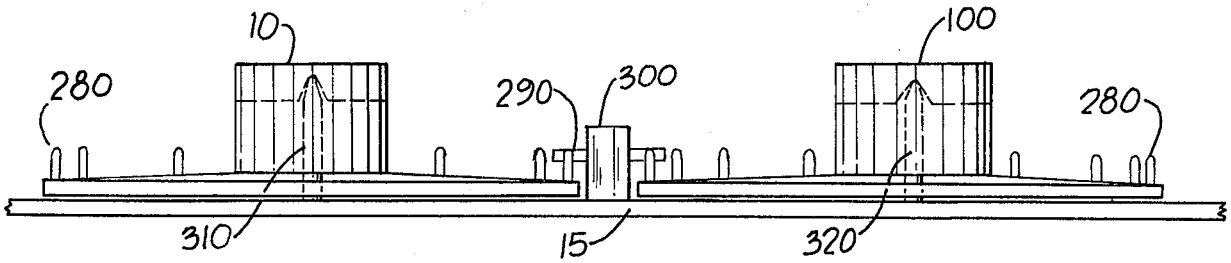
FIG. 6 is a side view of the spinners and pointer.

In FIG. 6, the spinners, 10 and 100 have pegs 280 that stop the spinners by contacting a pointer 290 mounted 300 between the two spinners, 10 and 100. Each spinner 10 and 100, is mounted on a pivot, 310 and 320, attached to the playing board 15.

Having described a preferred embodiment of my invention, it is understood that various changes can be made without departing from the spirit of my invention, and I desire to cover by the appended claims all such modifications as fall within the true spirit and scope of my invention.

What I claim and seek to secure by Letters Patent is:

1. A game of track and field sports, comprising:

a grease pencil, a score card indicating a plurality of track and field sports events and means of scoring a plurality of players, a plurality of simulated runner pieces, whereby a player can indicate the position reached by the player in an event chosen from among dashes, runs, and relays, a track whereon is marked the path for a plurality of players and is marked a run and relay start and finish mark, a start mark for the 100 yard dash, a quarter mile mark, a finish mark for the 100 yard dash, a finish mark for the 220 yard dash, & a three quarter mile mark, a first spinner marked with concentric rings and random numbers in each ring, whereby a player can determine his moves in run dash and relay events, & a second spinner marked with concentric rings and random measurements in each ring and marked with a lose turn space, whereby a player can determine his moves in events selected from pole vaults, shot puts, high jumps, and long jumps, pegs mounted on each spinner, & a member fixedly mounted to a field between the spinners having on opposite sides thereof flexible members each engaging one set of pegs, whereby the spinner will be stopped at a particular value.

* * * * *